US005964545A

United States Patent [19]

Cheng

[11] Patent Number: 5,964,545

[45] Date of Patent: Oct. 12, 1999

[54] FOLDING DEVICE FOR A PLAYYARD

[76] Inventor: Shu-Chen Cheng, 4th Fl., No. 3, Lane 35, Sec. 7, Chungshen N. Rd., Taipei, Taiwan

[21] Appl. No.: 08/959,023

[22] Filed: Oct. 28, 1997

[51] Int. Cl.[6] ..... F16C 11/10

[52] U.S. Cl. ..... 403/102; 403/100; 403/325; 5/98.1; 5/99.1

[58] Field of Search ..... 403/102, 101, 403/100, 321, 325, 84; 5/93.1, 98.3, 98.1, 99.1; 16/326, 343

[56] References Cited

U.S. PATENT DOCUMENTS

| | | | |
|---|---|---|---|
| 5,197,154 | 3/1993 | Shamie | 5/99.1 |
| 5,353,451 | 10/1994 | Hsiung | 5/99.1 |
| 5,446,931 | 9/1995 | Wei | 5/98.1 |
| 5,474,404 | 12/1995 | Chien | 403/102 |
| 5,483,710 | 1/1996 | Chan | 5/99.1 |
| 5,530,977 | 7/1996 | Wang | 5/99.1 |
| 5,611,634 | 3/1997 | Wang | 403/102 |
| 5,730,542 | 3/1998 | Cheng | 403/102 |
| 5,761,755 | 6/1998 | Huang | 5/99.1 |
| 5,781,944 | 7/1998 | Huang | 5/99.1 |

*Primary Examiner*—Harry C. Kim
*Attorney, Agent, or Firm*—Hedman, Gibson & Costigan, P.C.

[57] ABSTRACT

A folding device mounted between two sections of one rail of a playyard to achieve a folding of the playyard is disclosed. The folding device includes a sheet body bent to integrally form front plate, a rear plate opposed to the front plate and a middle arcuate plate coupling top edges of the front plate and the rear plate. A press button has a rectangular pedestal with a stepped portion received in an channel defined in the rear plate and a protrusion integrally extending from the stepped portion of the pedestal and selectively projecting beyond a hole defined in the front plate of the sheet body. A spring is compressed between the rear plate and a back of the pedestal for selectively urging the press button.

4 Claims, 9 Drawing Sheets

FOLDING DEVICE FOR A PLAYYARD

BACKGROUND OF THE INVENTION

1. Field of the Invention

The present invention relates to a folding device, and more particularly to a folding device for a playyard, which has simple structure and can be easily operated.

2. Description of Related Art

Playyards are widely used for safe occupation by a child. Early playyards were generally made of wood and designed with a fixed structure. Later, to meet the needs of space saving and convenient storage, foldable playyards were developed and became popular. Two related examples are respectively shown in FIG. 9 and FIG. 10. The foldable playyards in FIG. 9 substantially comprises four vertical side rods B and an upper frame and a lower frame (both not numbered) supported by the four vertical side rods B. The upper frame and the lower frame are respectively composed of four rails A which are connected by hinges (not numbered). Each rail A is divided into two sections and the folding of the playyard is accomplished by a folding device 1 connected between two sections of the rail A of the playyard. The foldable playyards in FIG. 10 substantially comprises four vertical side rods C and an upper frame and a lower frame (both not numbered) supported by the four vertical side rods C. The upper frame is composed of four rails D which are connected by hinges (not numbered). Each rail D is divided into two sections and has a folding device connected between the two sections thereof. The lower frame is composed of four pairwise orthogonal rails E coupled by a pivot (not numbered). The folding of this playyard is accomplished by the folding device and the pivot. Though the above mentioned examples of folding device can achieve a folding of the playyard, they still have relatively complex structures.

The present invention provides a novel folding device for a playyard to mitigate and/or obviate the aforementioned problems.

SUMMARY OF THE INVENTION one object of the present invention is to provide a folding device for a playyard, which has simple structure and can be easily operated.

In accordance with one aspect of the present invention, a folding device is mounted between two sections of a rail of a playyard to achieve a folding thereof. The folding device includes a sheet body bent to integrally form a front plate, a rear plate opposed to the front plate and a middle arcuate plate coupling top edges of the front plate and the rear plate. The front plate defines a hole in a center thereof. A middle portion of the rear plate further is bent to define a channel. The channel defines a first socket aligning with the hole of the front plate. A press button has a rectangular pedestal with a stepped portion received in the channel of the rear plate and a protrusion integrally extending from the stepped portion of the pedestal and selectively projecting beyond the hole of the front plate of the sheet body. The pedestal has two truncated bevels respectively at two corners of the stepped portion and defines a second socket in a back thereof aligning with the first socket of the rear plate of the sheet body. Resilient means is compressed between the first socket of the rear plate of the sheet body and the second socket of the press button for selectively urging the press button.

The accordance with another aspect of the present invention, the front plate, the stepped portion of the pedestal of the press button and the rear plate respectively define two through holes aligning with each other for two pivots to be respectively extended therethrough.

In accordance with a further aspect of the present invention, a top face of said pedestal is configured as a cambered surface corresponding to the middle arcuate plate of the sheet body.

In accordance with still a further aspect of the present invention, the front plate and the rear plate each have formed thereon two pairs of opposed lugs respectively at a top of two distal ends thereof the receive two opposed ends of two sections of a rail of the playyard therebetween, each pair of opposed lugs defining therein two apertures aligning with each other for a bolt to be extended there-through to secure a corresponding section of the rail.

Other objects, advantages and novel features of the invention will become more apparent from the following detailed description when taken in conjunction with the accompanying drawings.

DETAILED DESCRIPTION OF PREFERRED EMBODIMENT

Figure 1:
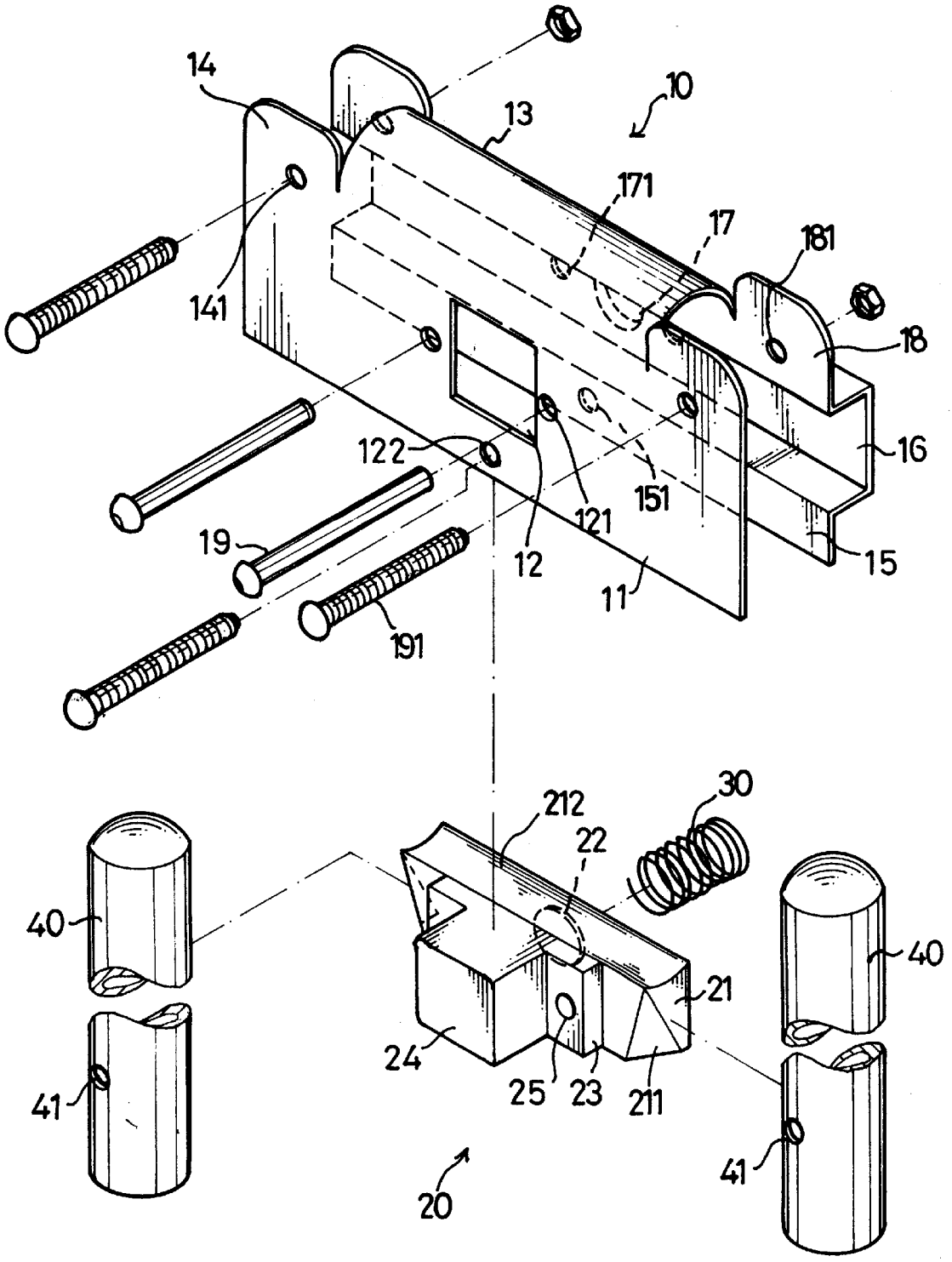
FIG. 1 is an exploded perspective view showing the elements of a folding device for a playyard in accordance with the present invention.
Figure 9:
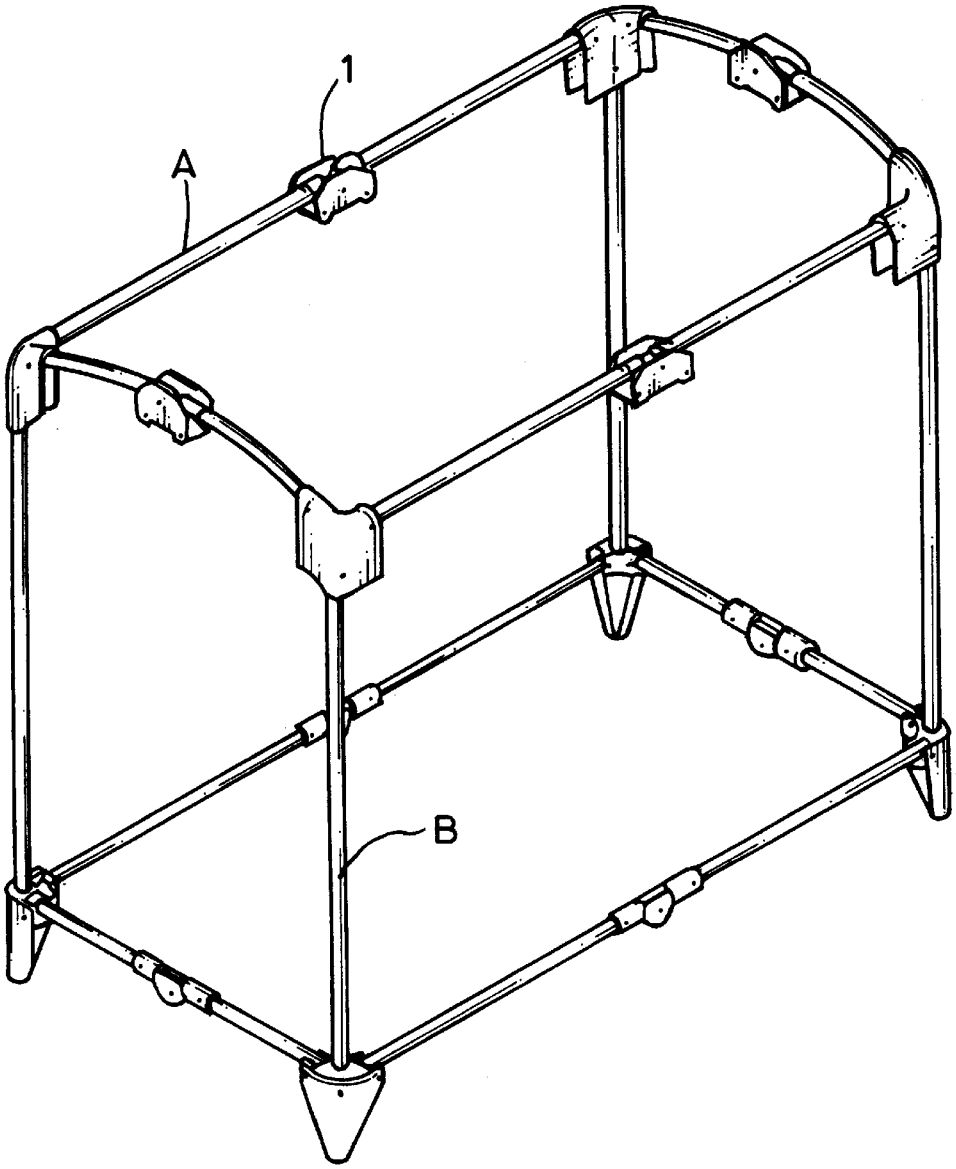
FIG.9 PRIOR ART
FIG. 9 is a perspective view showing a conventional playyard employing a folding device in accordance with Taiwan Patent No. 215545.
Figure 10:
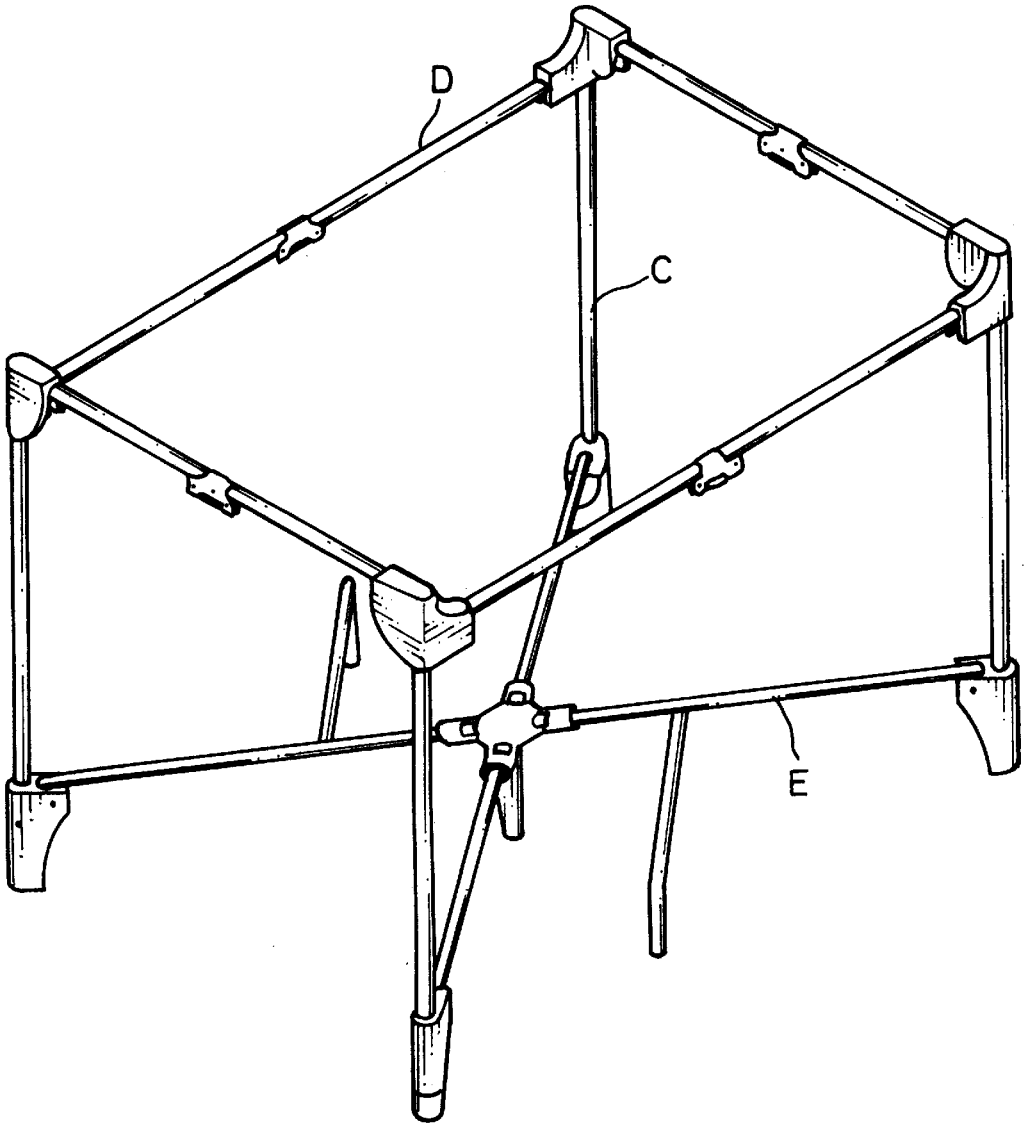
FIG. 10 PRIOR ART
FIG. 10 is a perspective view showing another convention playyard employing a folding device in accordance with Taiwan Patent No. 224229.

A common playyard generally comprises four vertical side rode and an upper frame and a lower frame supported by the four vertical side rods (as shown in FIG. 9). The upper frame and the lower frame are respectively composed of four rails which are connected by hinges (not numbered). A bed with enclosures is provided between the upper frame and the lower frame for a child to be enclosed therein. The enclosures are generally formed by cloth wrapped between the rails of the upper frame and the bed. A folding device for a playyard in accordance with the present invention is used in each rail 40 of the playyard (not shown) for achieving a folding thereof. Referring to FIG. 1, in preferred embodiment, the rail 40 is divided into two sections and the folding device is connected between the two sections of the rail 40. The folding device essentially includes a sheet body 10 which is bent to integrally form front plate 11, a rear plate 15 opposed to the front plate 11 and a middle arcuate plate 13 coupling top edges (not numbered) of the front plate 11 and the rear plate 15. The front plate 11 defines a large hole 12 in a center thereof, two small holes 121 respectively at two sides defining the large hole 12, and a front locating hole 122 in an appropriate position below the large hole 12. The front plate 11 further has two front lugs 14 respectively formed at a top of two distal ends thereof, each front lug 14 defining a first aperture 141 therein. The rear plate 15 defines a rear locating hole 151 aligning with the front locating hole 122 of the front plate 11 and has two rear lugs 18 respectively formed at a top of two distal ends thereof, each rear lug 10 defining a second aperture 181 opposed to the first aperture 141 of the front lug 14. In addition, a middle portion of the rear plate 15 is bent to define a channel 16. The channel 16 defines a first socket 17 in an appropriate position thereof and two small holes 171 in two opposed sides of the first socket 17 to be respectively aligned with the small holes 121 of the front plate 11.

Figure 2:
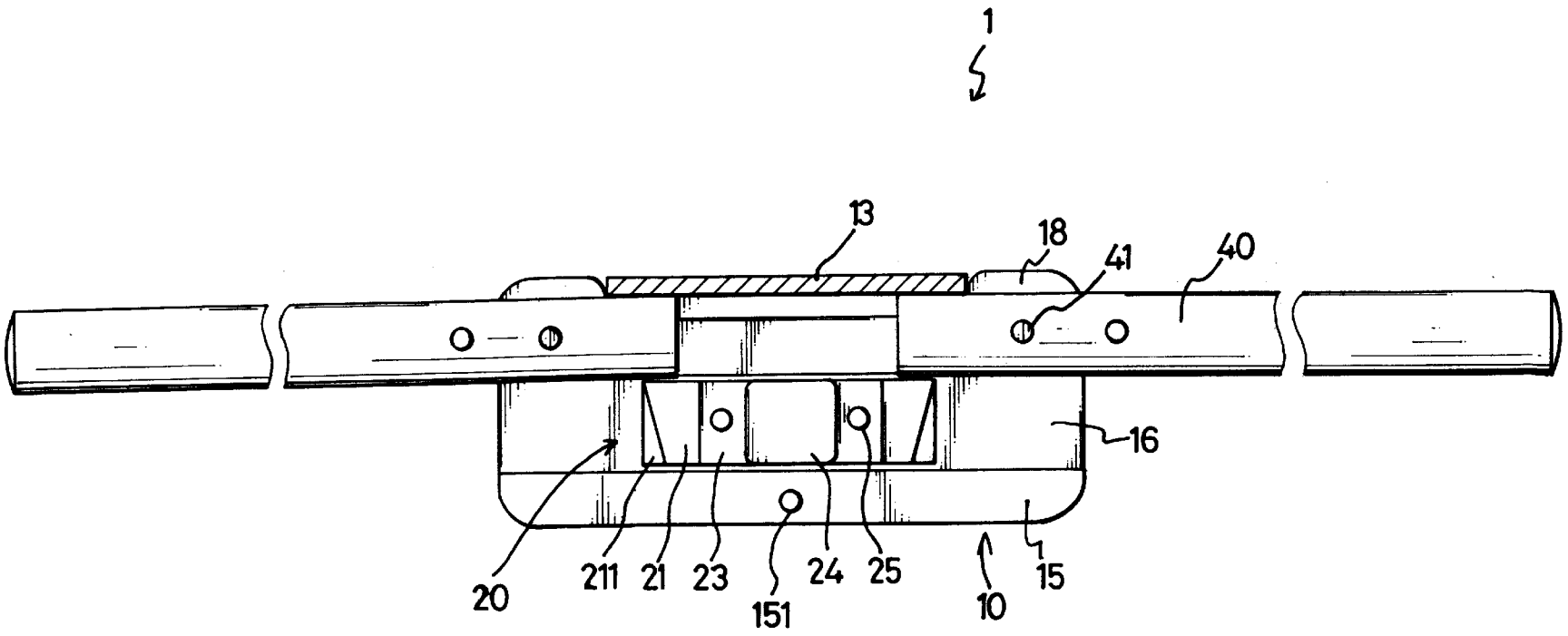
FIG. 2 is a partly sectional view shoeing the combined structure of the folding device of FIG. 1.

The folding device in accordance with the present invention further includes a press button 20. The press button 20 has a substantially rectangular pedestal 21 with a stepped portion 23 formed at a front thereof. The rectangular pedestal 21 is designed to be movably received in the channel 16 of the rear plate 15. The pedestal 21 has two truncated bevels 211 formed at two corners of the stepped portion 23 and defines a second socket 22 in a back thereof. The second socket 22 is aligned with the first socket 17 of there rear plate 15 of the sheet body 10 so that a spring 30 can be compressed therebetween for selectively urging the press button 20. The press button 20 further includes a protrusion 24 integrally extending from the stepped portion 23 of the pedestal 21. The protrusion 24 is designed to movably project beyond the large hole 12 of the front plate 11 of the sheet body 10. The stepped portion 23 of the rectangular pedestal 21 defines two through holes 25 therein to be respectively aligned with the small holes 121 of the front plate 11 and the small holes 171 of the rear plate 15, whereby two pivots 19 can be correspondingly extended through the small holes 121, the through holes 25 and the small holes 171 to pivotably mount the press button 20 between the front plate 11 and the rear plate 15. Then a screw (not numbered) extends through the front locating hole 122 of the front plate 11 and the second locating hole 151 of the rear plate 15 and is engaged with a nut (not numbered) to locate the press button 20 within the sheet body 10. In addition, a top face of the pedestal 21 is configured as cambered surface 212 to be opposed to the middle arcuate plate 13 of the sheet body 10 so that two opposed ends of the two sections of the rail 40 can be received between the cambered surface 212 and the middle arcuate plate 13. Also, the two sections of the rail 40 respectively define a transverse bore 41 in the two opposed ends thereof aligning with a corresponding one of the first aperture 141 and a corresponding one of the second aperture 181 so that a bolt 191 can be extended through the respective apertures 141, the transverse bore 41, and the respective apertures 181 to pivotally mount the two sections of the rail 40 between the front plate 11 and the rear plate 15, as shown in FIG. 2. After being engaged with the folding device 10, the two sections of the rail 40 can be respectively joined with a corresponding vertical side rod of the playyard.

Figure 3:
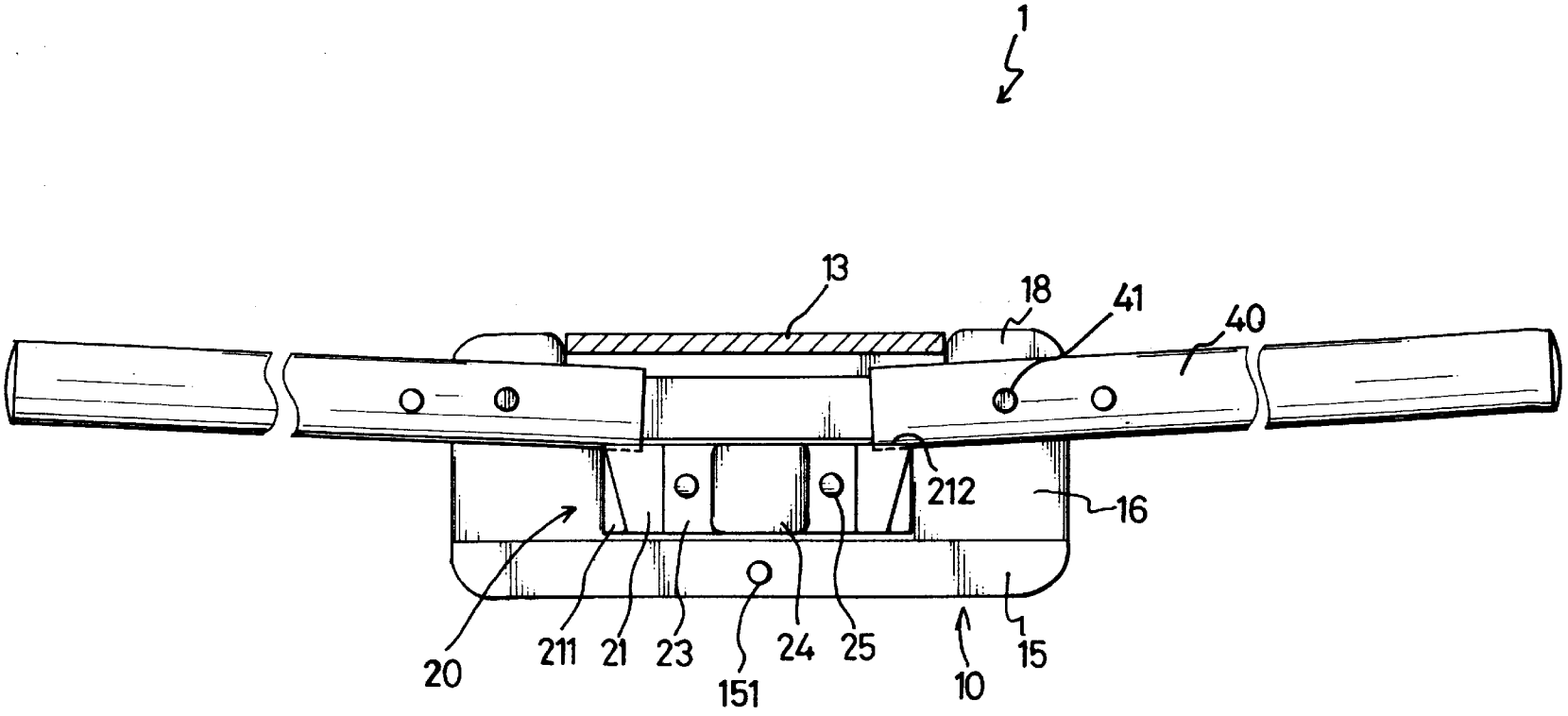
FIG. 3 is a partly sectional view showing a state of the folding device in the case that a very young child has been put into the playyard.

Referring to FIG. 2, in an unfolded state, the spring 30 between the press button 20 and the rear plate 15 urges the press button 20 in virtue of its own elastic force to make the protrusion 24 project beyond the large hole 12 of the front plate 10. Referring to FIG. 3, after the child has been seated in a playyard (not shown), the bed is applied a force resulted by the weight of the child, therefore the two opposed ends of the two respective sections of the rail 40 will be slightly pulled downward by the enclosures wrapped between the rail 40 and the bed. As a result, the two opposed ends of the two sections of the rail 40 will tightly retain the cambered surface 212 of the press button 20 to restrict the press button 20 to be operated, Accordingly, the playyard will be maintained in the unfolded state. Meanwhile, the press button 20 can be fastened to achieve safeties.

Figure 4:
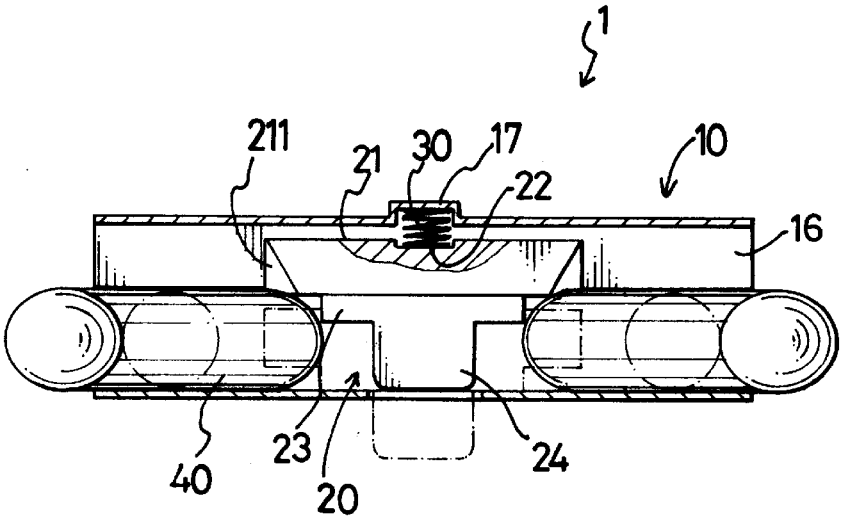
FIG. 4 is a partly sectional view showing a first step of a folding operation of the playyard.
Figure 5:
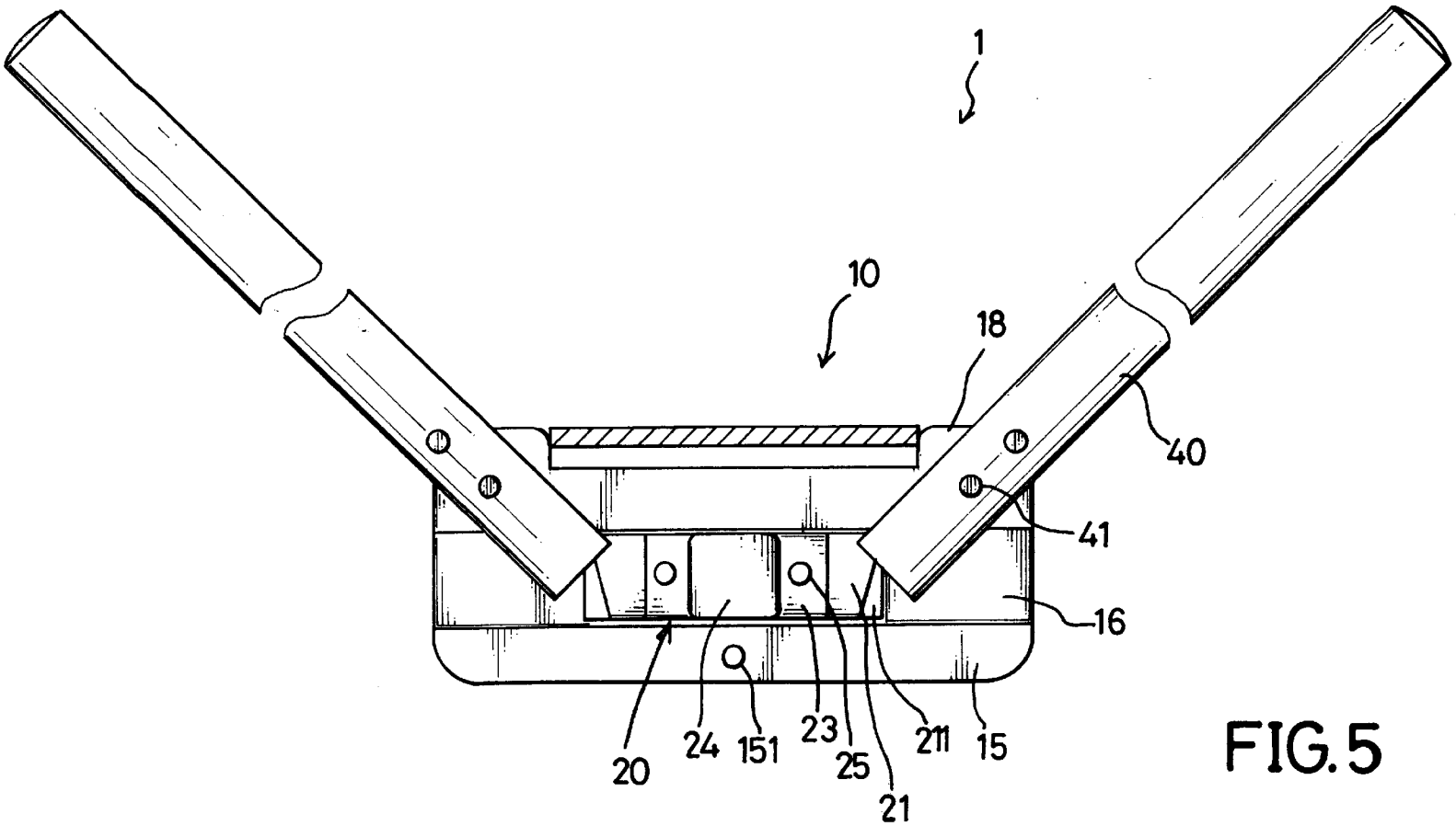
FIG. 5 is a partly sectional view showing a third step of folding operation of the playyard.
Figure 6:
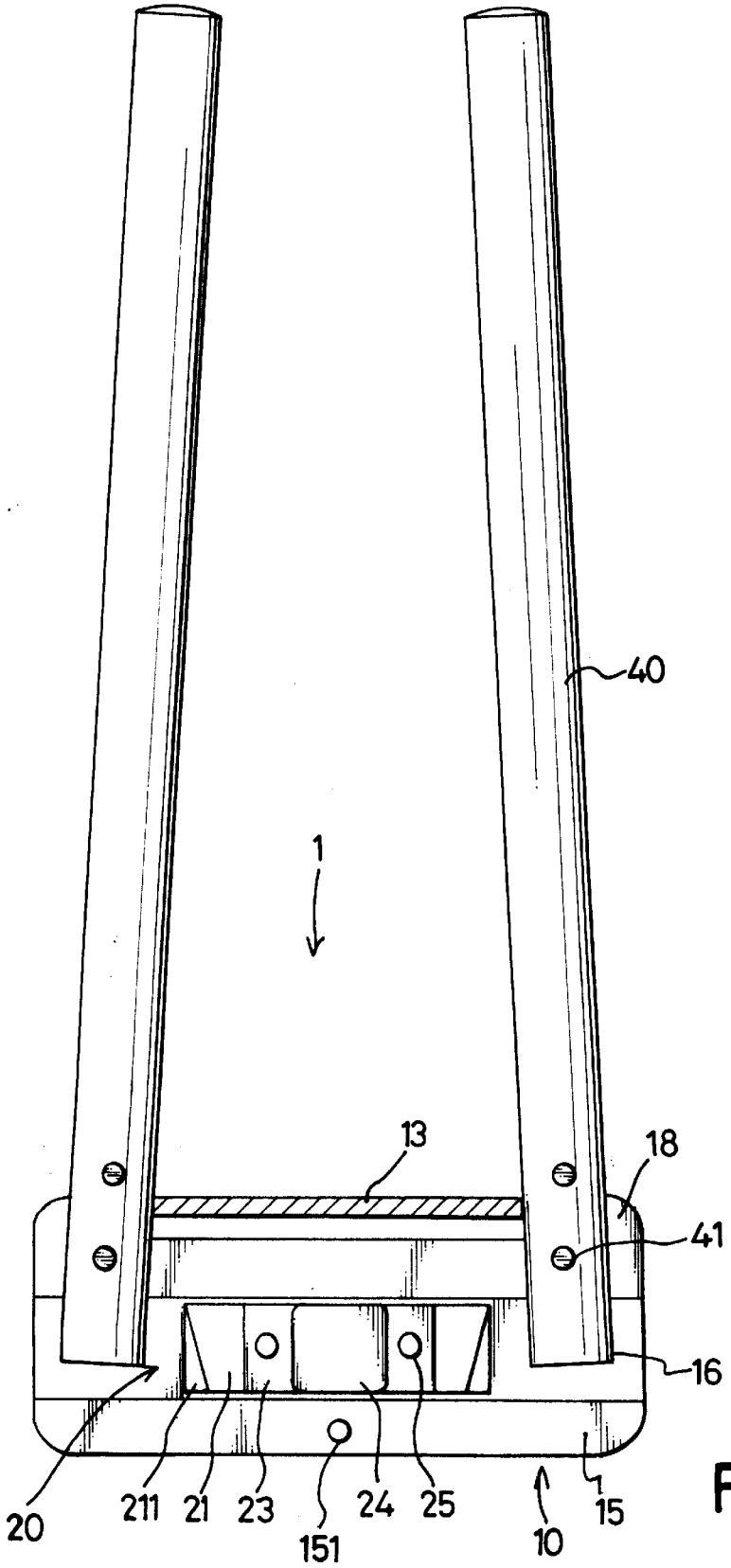
FIG. 6 is a partly sectional view showing a third step of folding operation of the playyard.
Figure 7:
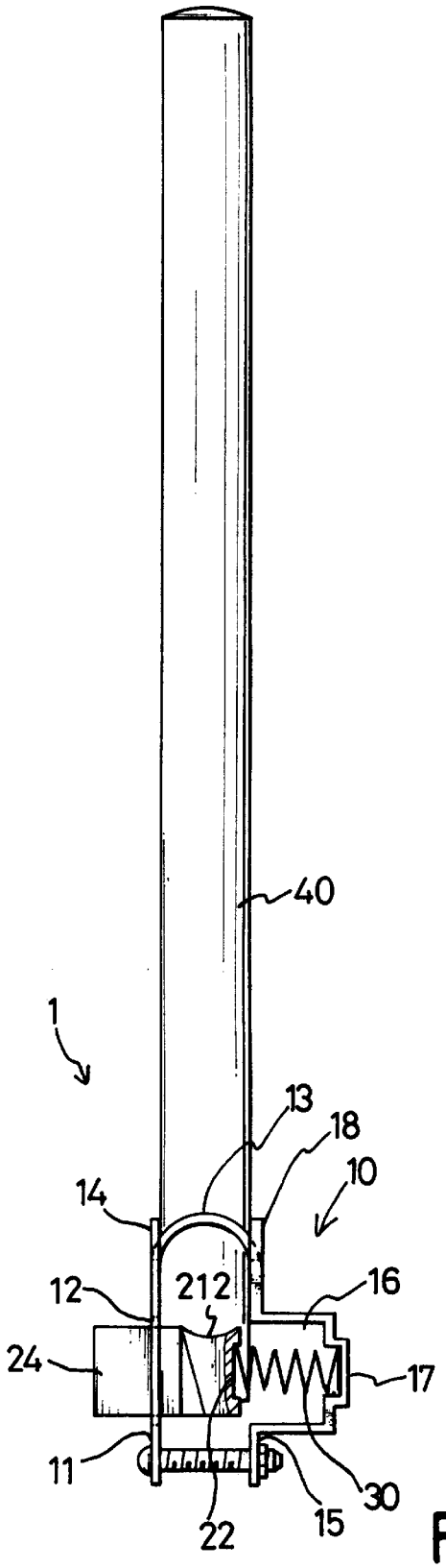
FIG. 7 is a sectional view showing a state of the folding device after folding operation is completed.

Referring to FIG. 4, when the playyard is to be folded, a user may fetch the child from the playyard first. Since the weight of the child applied to the cradle is removed, the two opposed ends of the rail 40 will restore to their initial state and not restrict the press button 20 any more. Therefore, the protrusion 24 of the press button 20 can be continuously pushed inward to concealed within the folding device. At this time, the two opposed ends of the rail 40 will separate from the cambered surface 212 of the press button 20 and can be pivoted in opposite directions (see FIG. 5) until they reach the positions as shown in FIG. 6, Finally, by releasing the load on the press button 20, the protrusion 24 will again project from the large hole 12 of the sheet body 10 and the press button 20 is relocated to prevent the rail 40 from pivoting, as shown in FIG. 7.

Figure 8:
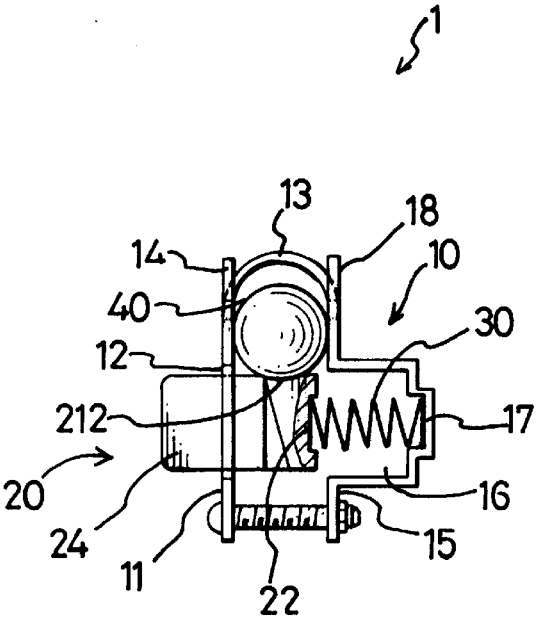
FIG. 8 is a sectional view showing an unfolding operation of the folding device in accordance with the present invention.

Referring to FIG. 8, when the playyard is to be re-unfolded again, the user may apply a force to the rail 40 to pivot the rail 40. Then the opposed ends of the rail 40 respectively travel along the two bevels 211 of the pedestal 21 of the press button 20 and compress the spring 30 by urging the bevels 211. After the two opposed ends of the rail 40 complete travel across the bevels 211, the spring 30 will urge the press button 20 to make the protrusion 24 again project from the large hole 12, as shown in FIG. 8, whereby the playyard is prepared for usage.

Accordingly, the present invention provides a folding device for a playyard, which can be easily operated without additional tools.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A folding device to be mounted between two sections of one rail of a playyard to achieve a folding thereof, said folding device comprising:

a sheet body bent to integrally form a front plate, a rear plate opposed to the front plate and a middle arcuate plate coupling top edges of the front plate and the rear plate, said front plate defining a hole in a center thereof, a middle portion of said rear plate further being bent to define a channel, said channel defining a first socket aligning with the hole of the front plate;

a press button having a rectangular pedestal with a stepped portion received in the channel of the rear plate and a protrusion integrally extending from the stepped portion of the pedestal and selectively projecting beyond the hole of the front plate of the sheet body, said pedestal having two truncated bevels at two corners of the stepped portion and defining a second socket in a back thereof aligning with the first socket of the rear plate of the sheet body; and resilient means compressed between the first socket of the rear plate of the sheet body and the second socket of the press button for selectively urging the press button.

2. A folding device for a playyard as claimed in claim 1, wherein said front plate, said stepped portion of the pedestal of the press button and said rear plate respectively define two through holes aligning with each other for two pivots to be respectively extended therethrough.

3. A folding device for a playyard as claimed in claim 2, wherein a top face of said pedestal is configured as a cambered surface corresponding to the middle arcuate plate of the sheet body.

4. A folding device for a playyard as claimed in claim 3 wherein said front plate and said rear plate respectively have formed two pair of opposed lugs respectively at a top of two distal ends to receive two opposed ends of the two sections of the rail therebetween, each pair of opposed lugs defining therein two apertures aligning with each other for a bolt to be extended therethrough to secure a corresponding section of the rail.

* * * * *